United States Patent [19]

Mitsui et al.

[11] 4,352,080

[45] Sep. 28, 1982

[54] FERRITE CORE

[75] Inventors: Tadashi Mitsui, Tokyo; Masaru Wasaki, Ichihara; Junpei Ohta, Matsudo, all of Japan

[73] Assignee: TDK Electronics Co., Ltd., Tokyo, Japan

[21] Appl. No.: 188,978

[22] Filed: Sep. 19, 1980

[30] Foreign Application Priority Data

Sep. 25, 1979 [JP] Japan ..... 54-132150[U]

[51] Int. Cl.[3] ..... H01F 27/24

[52] U.S. Cl. ..... 336/83; 336/233

[58] Field of Search ..... 336/83, 212, 217, 233, 336/234

[56] References Cited

U.S. PATENT DOCUMENTS

| | | | |
|---|---|---|---|
| 2,608,610 | 8/1952 | Thulin | 336/83 X |
| 2,811,203 | 10/1957 | Garbarino | 336/217 X |
| 2,849,696 | 8/1958 | Moynihan | 336/212 |
| 2,932,787 | 4/1960 | Krabbe et al. | 336/212 X |
| 3,007,125 | 10/1961 | Furbee | 336/212 X |
| 4,158,186 | 6/1979 | Philberty et al. | 336/217 |

FOREIGN PATENT DOCUMENTS

| | | | |
|---|---|---|---|
| 1439276 | 10/1968 | Fed. Rep. of Germany | 336/83 |
| 300265 | 4/1968 | Sweden | 336/83 |
| 1169742 | 11/1969 | United Kingdom | 336/83 |
| 1306597 | 2/1973 | United Kingdom | 336/83 |

*Primary Examiner*—Thomas J. Kozma
*Attorney, Agent, or Firm*—Armstrong, Nikaido, Marmelstein & Kubovcik

[57] ABSTRACT

The new structure of a ferrite core for the use of a power transformer and/or a choke coil has been found. The core is assembled by a pair of identical core halves, and each of core half comprises (a) a circular center boss(12), (b) a pair of outer walls(14,16) positioned at both the sides of said boss(12) so that a fan-shaped empty space is provided between the circular boss(12) and a pair of outer walls(14,16) for mounting a coil, (c) a pair of base plates(18,20) coupling said boss(12) with said outer walls(14,16) at the extreme end of those members so that those members conform substantially with the E-shaped structure, (d) the other extreme end of said boss(12), the outer walls(14,16) and the base plates(18,20) residing on a single plane, (e) each of said outer walls(14,16) being essentially rectangular with the external linear wall and the inner curved wall which is coaxial with the circular boss(12), and the width($d_2$) of said external linear wall is larger than the diameter($d_3$) of the circular boss(12), (f) each of said base plates(18,20) being essentially in the sector shaped having a pair of tapers which are gradually opened towards the outer walls(14,16), (g) the area($S_3$) coupling the base plates(18,20) with the outer walls(14,16) being larger than the half of the cross sectional area($\frac{1}{4}\pi d_3^2$) of the boss(12), (h) the area($S_2$) coupling the boss(12) with the base plates(18,20) being substantially the same as half of the cross sectional area($\frac{1}{4}\pi d_3^2$) of the boss(12), and (i) the area($S_1$) of the cross section of each of the outer walls(14,16) being essentially the same as half of the cross sectional area($\frac{1}{4}\pi d_3^2$) of the boss(12).

2 Claims, 10 Drawing Figures

FERRITE CORE

BACKGROUND OF THE INVENTION

The present invention relates to the structure of a ferrite core, in particular, relates to such a core for the use of a transformer and/or a choke coil in a power supply circuit. The present ferrite core is utilized for a transformer and/or a choke coil in a power supply circuit in electric appliances up to 1 kW.

When the present core is utilized for a power transformer a primary power supply is applied to the transformer through a switching circuit operating by a DC power supply applying an alternate current input to the transformer, and thus, the desired secondary voltage is obtained at the output of the transformer.

When a ferrite core is utilized for a power transformer, that core must at least satisfy the following conditions.

(a) A core must not magnetically saturate, and preferably, the cross section along the magnetic path is identical for the whole magnetic path in the core.

(b) A core is preferably closed by itself for improving the shield effect for not disturbing an external circuit.

(c) The shape of a core is preferably simple, and a bobbin having windings can be easily mounted in a core, and lead wires of windings can extend easily outside of a core.

(d) A core must satisfy the lawful safety standard for a power supply circuit issued in each country. The safety standard requests for instance the minimum duration between pins, the minimum duration between a core and a pin, et al.

(e) A core must be small in size, and light in weight. And the output power of a transformer for each unit weight(gr) is as large as possible.

(f) Preferably, the external shape of a core is rectangular for saving the mounting area of the transformer on a printed circuit board, and the shape of the central core is circular for the sake of the winding.

(g) The manufacturing process of a core is simple, and a core is mechanically strong. If a core has a sharp or edged portion, that portion will be broken easily.

The most popular conventional ferrite core is in E-shaped with the identical cross section, or alternatively, a combination of the E-shaped core and the I-shaped core is utilized. However, that core has the disadvantages that the size is large, the shield effect is not perfect, and further since a bobbin must be rectangular, windings are folded and thus, the insulation is not sufficient and the automatic winding is impossible.

Another conventional ferrite core is a so-called pot core which has a closed outer wall and a center core mounted at the center of the wall. Although a pot core is excellent in the shield effect, that pot core has the disadvantage that it is difficult to extend lead wires of windings outside, since a slit for accepting lead wires is too small in that pot core.

Another prior ferrite core is shown in UK patent No. 1306597 which has a pair of thick diametrically opposed outer legs. That core is proposed for the use in a high frequency filter, but is not suitable for a power supply transformer, since the shield effect is poor, and the size is large.

Another prior ferrite core is shown in UK patent No. 1169742 which has four legs and the center core at the center of those legs. Although that core is advantageous to extend lead wires to an external circuit through the wide window between legs, that core has the disadvantage that the core is apt to saturate at the leg portions, since those legs are rather thin. Therefore, that core is advantageous for the use of the high output voltage application, but is not suitable for a power supply transformer.

Another prior ferrite core is the modification of a so-called pot core, and a pot core is separated into two substantially U-shaped portions. This shape is preferable to improve the shield effect, but has the disadvantage that it is difficult to connect lead wires to an external circuit.

Still another prior ferrite core has the wide disk between the center core and the outer walls. However, in this core, the structure of a bobbin is rather complicated, and the core is apt to saturate, thus, that core is not suitable for the use of a high power transformer.

SUMMARY OF THE INVENTION

It is an object, therefore, of the present invention to overcome the disadvantages and limitations of a prior ferrite core by providing a new and improved ferrite core.

It is also an object of the present invention to provide a ferrite core for the use of power supply circuit with no magnetic saturation, small size, and the excellent shield effect.

The present ferrite core is assembled by a pair of the identical core halves, and each of core halves is comprised (a) a circular center boss(12), (b) a pair of outer walls(14,16) positioned at both the sides of said boss(12) so that a fan-shaped empty space is provided between the circular boss(12) and a pair of outer walls(14,16) for mounting a coil, (c) a pair of base plates(18,20) coupling said boss(12) with said outer walls(14,16) at the extreme end of those members so that those members conform substantially the E-shaped structure, (d) the other extreme end of said boss(12), the outer walls(14,16) and the base plates(18,20) residing on a single plane, (e) each of said outer walls(14,16) being substantially rectangular with the external linear wall and the inner curved wall which is coaxial with the circular boss(12), and the width($d_2$) of said external linear wall being larger than the diameter($d_3$) of the circular boss(12), (f) each of said base plates(18,20) is substantially in the sector shape having a pair of tapers which are gradually opened towards the outer walls(14,16), (g) the area($S_3$) coupling the base plate(18,20) with the outer walls(14,16) being larger than the half of the cross sectional area($\frac{1}{4}\pi d_3^2$) of the boss(12), (h) the area($S_2$) coupling the boss(12) with the base plates(18,20) being substantially the same as half of the cross sectional area($\frac{1}{4}\pi d_3^2$) of the boss(12), and (i) the area($S_1$) of the cross section of each of outer walls(14,16) being substantially the same as half of the cross sectional area($\frac{1}{4}\pi d_3^2$) of the boss(12).

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENT

Figure 1:
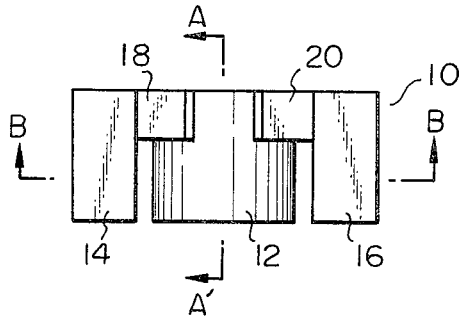
FIG. 1 is the vertical view of the core half according according to the present invention.

The transformer utilizing the present ferrite core utilizes two substantially identical core halves of magnetic material butting together, and a core half 10 us shown in FIGS. 1 through 8. In those figures, the core half 10 according to the present invention is formed integrally with a circular boss 12, a pair of outer walls 14 and 16, and a pair of base plates 18 and 20 connecting said boss 12 and said outer walls 14 and 16. The inner faces 14*a* and 16*a* of the two outer walls 14 and 16 are inwardly curved so that when a core half is formed by assembling two core halves with their outer portions and boss butting together a cylindrical space is left around the boss and between the outer walls for accommodating a bobbin and one or more coils wound on the bobbin.

Figure 2:
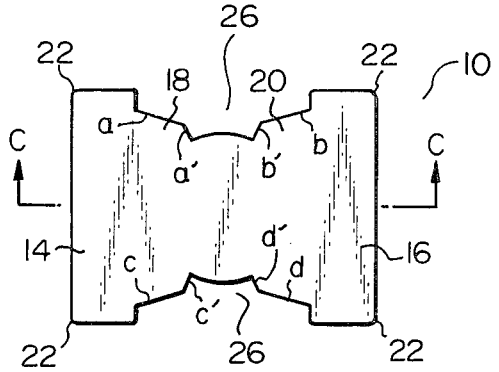
FIG. 2 is the top view of the core half according to the present invention.
Figure 3:
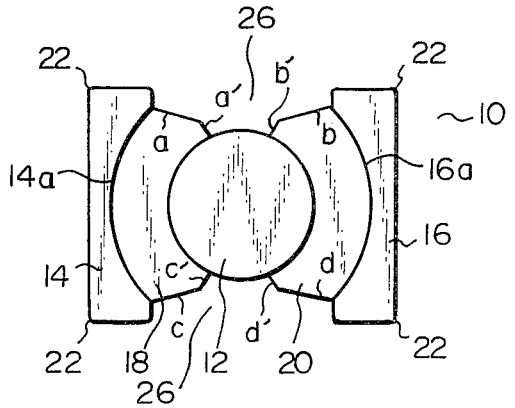
FIG. 3 is the bottom view of the core half according to the present invention.
Figure 4:
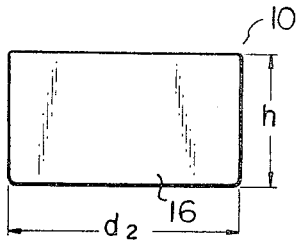
FIG. 4 is the side view of the core half according to the present invention.
Figure 5:
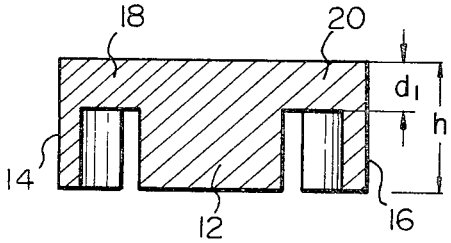
FIG. 5 is the cross sectional view at the line C—C of FIG. 2.
Figure 6:
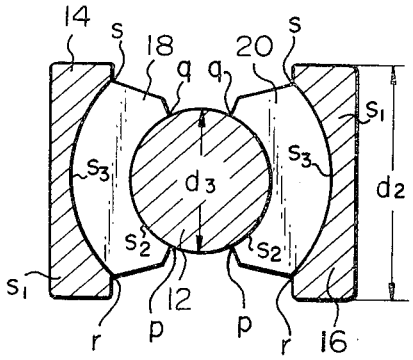
FIG. 6 is the cross sectional view at the line B—B of FIG. 1.
Figure 7:
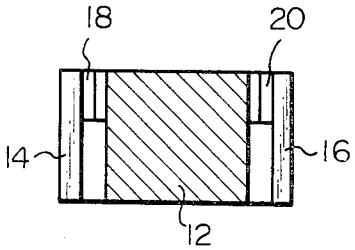
FIG. 7 is the cross sectional view at the line A—A of FIG. 1.
Figure 8:
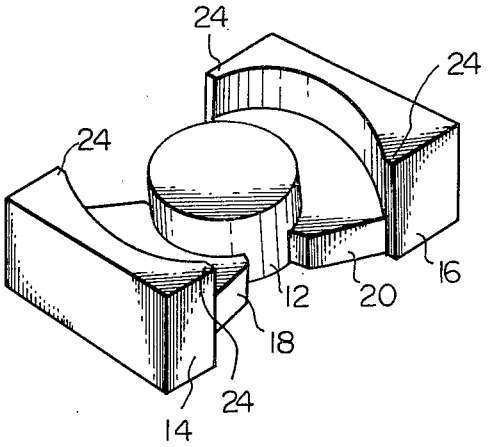
FIG. 8 is the perspective view of the core half shown in the above FIGS. 1 through 7.

The boss 12 is in the shape of a circular post as shown in each of the drawings. Each of the outer walls 14 and 16 are a substantially rectangular plate but the inner surface of the same is curved. The height (h) of the outer walls is the same as the height of the boss 12. At the end of boss 12 and the outer portions 14 and 16, a pair of fan-shaped base plates 18 and 20 are provided, and as apparent from each of the drawings, the inner surface of those base plates coincides with the outer surface of the boss 12, and the outer surface of those base plates coincides with the inner curved surface of the outer walls 14 and 16. It should be appreciated that each of outer walls 14 and 16 are positioned so that they are symmetrical with regard to the boss 12, and the curved inner surfaces of those outer walls 14 and 16 are coaxial with the center boss 12. Further, the external wall of the first outer wall 14 is parallel to that of the second outer wall 16, so that the external appearance of the present core half is almost rectangular. The length $d_2$ of the outer portions 14 and 16 is longer than the diameter $d_3$ of the boss 12. Therefore, the top view and/or the bottom view of the present core half is substantially rectangular as shown in FIGS. 2 and 3 leaving the empty spaces 26 around the boss 12. The relation that the length $d_2$ of the outer portions 14 and 16 is longer than the diameter $d_3$ of the boss 12 is one of the features of the present invention, and because of that relation, the outer wall 14 and 16 enclose substantially the boss 12 and the windings (not shown) wound on the boss 12, and then, the outer walls 14 and 16 provide the excellent shield effect with the transformer. Further, lead wires of windings may go out through those open spaces 26.

Of course, it should be appreciated that one end of the boss 12, the outer walls 14 and 16, and the sector shaped base plates 18 and 20 are on the same plane as shown in FIG. 1, and the other end of the boss 12 and the outer walls 14 and 16 are on another plane for butting with the other core half.

The pair of fan-shaped or sector-shaped base plates 18 and 20 have tapered sides (a,b,c and d) extending from the inner surface of the outer walls, and those tapered sides (a,b,c, and d) are offset near the boss 12, thus, the second tapered sides (a', b', c' and d') are provided between the first tapered sides (a,b,c and d) and the boss 12. Of course the opening angle of the second tapers are larger than that of the first tapers. Because of the presence of said second tapered sides (a', b', c', d'), no sharp or edged portion exists at the coupling portion between the outer walls 14 and 16, and the central boss 12, and that structure with no sharp portion will increase the lift time of dies for manufacturing core halves.

The external corners 22 and the internal corners 24 of the outer walls 14 and 16 are curved by removing the edges so that those corners do not have a sharp edge which will be easily broken. Then, due to the curved corners, the present core is mechanically strong, and is not broken. However, it should be noted that the corners may be edged as far as the function of the transformer concerns.

In order to assure the reasonable distribution of the magnetic flux in the core, and prevent the saturation of the magnetic flux in the core, the size of the core is selected as follows. First, the cross section ($S_1$) of the outer wall 14 or 16 is half as large as the cross section ($\frac{1}{4}\pi d_3^2$) of the boss 12 so that the magnetic flux in the boss 12 is shared in the two outer walls, and the flux density in the boss 12 is the same as that in the outer walls 14 and 16. Secondly, the area ($S_2$) for connecting the boss 12 to the base plate 18 or 20 is also half as large as the cross section ($\frac{1}{4}\pi d_3^2$) of the boss 12. That area ($S_2$) is equal to the product of the length of arc between p and q (see FIG. 6) and the thickness $d_1$ of the base plates 18 and 20 (see FIG. 5). Of course the cross section of the boss 12 is $\frac{1}{4}\pi d_{32}$, where $d_3$ is the diameter of the boss 12 and $\pi$ is 3.14. Next, the area ($S_3$) for coupling the base plate 18 or 20 to the outer wall 14 or 16 is larger than the half of the cross section of the boss 12, since the arc r–s (see FIG. 6) is longer than the arc p–q. That area ($S_3$) is the product of the arc r–s and the thickness $d_1$ of the base plates 18 and 20. It should be appreciated that the core having the above dimension relations never partially saturates magnetically.

Figure 10:
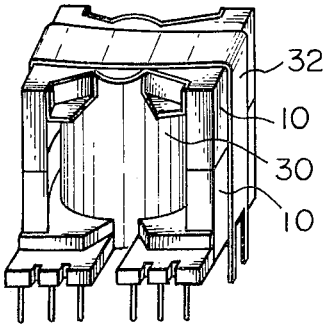
FIG. 10 is the assembled external appearance of the transformer utilizing the present ferrite core.
Figure 9:
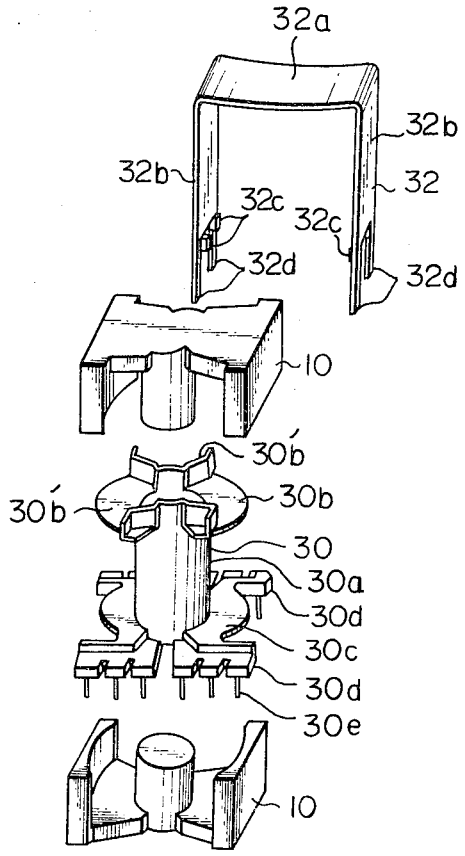
FIG. 9 is the disassembled view of the transformer utilizing the present ferrite core.

FIG. 9 and FIG. 10 show the transformer utilizing the present core halves. In those figures, a pair of core halves 10 are oppositely inserted in the bobbin 30 which has windings (not shown) so that the extreme ends of the bosses 12 and the outer walls 14 and 16 butt with each other, and thus, the close magnetic path through the central boss 12, the base plates 18 and 20, the outer walls 14 and 16, to the central boss 12 is obtained. The bobbin 30 is made of dielectic material, having a hollow cylindrical pipe 30*a* and a pair of flanges 30*b* at the extreme ends of said pipe 30*a*. The upper flange 30*b* has a pair of walls 30*b'* for accepting the top of the boss 12 and the tapered base plates 18 and 20. The lower flange 30*c* has a pair of terminal plates 30*d* extending substantially parallel to the tapered base plates 18 and 20. Each of the terminal plates 30*d* has a plurality of terminal pins 30*e* for the connection of the windings of the transformer to an external circuit. A resilient belt 32 is substantially U-shaped, and has a top arm 32*a*, a pair of side arms 32*b*, at least one projection 32*c* extending inwardly at the end of said side arm 32*b*. Further, a leg 32*d* extends at the end of a side arm 32*b*. In assembling a transformer, the bobbin 30 with windings (not shown) on the hollow pipe 30*a* accepts a pair of core halves 10. The bosses 12 of those core halves 10 are inserted in the hollow pipe 30*a* of the bobbin, and the side walls 14 and 16 of the core halves 10 are positioned outside the windings. As mentioned above, when the core halves are inserted in the bobbin, the core halves butt with each other to provide a closed magnetic path. The U-shaped resilient belt 32 holds a pair of core halves thus assembled together with the bobbin between the top arm 32*a* and the projections 32*c*. The assembled transformer thus clamped by the belt 32 is shown in FIG. 10.

The assembled transformer shown in FIG. 10 is mounted on a printed circuit board of an electric appliance by inserting pins 30*e* and legs 32*d* in holes of said printed circuit board. And the transformer is fixed on the printed circuit board by soldering the legs 32*d* to the circuit pattern of the board.

It should be appreciated in FIGS. 9 and 10, that windings are substantially enclosed by outer walls 14 and 16 of the core halves to provide the improved shield effect, and at the same time a pair of open spaces 26 are provided. And the wires from the windings are connected to the pins 30*e* through those open spaces 26. Therefore, enough length is guaranteed between core halves and lead wires to satisfy the safety standard in each countries.

According to the preferred embodiment of the present invention, the material of the core halves is Mn-Zn type ferrite having the permiability $\mu=2500$, and the preferable size of a core half for each output is listed below. According to the present core halves, the output power handled by a transformer can be more than 3 watts for each unit weight (gramms) in a 50 kHz forward converter while a prior core can only provide less than 2.5 watts for each unit weight.

| Item | Sample No. No. 1 | No. 2 | No. 3 | No. 4 | No. 5 |
|---|---|---|---|---|---|
| Cross section of a boss ($mm^2$) | 61 | 113 | 142 | 162 | 174 |
| Cross section of outer walls ($2 \times S_1$ $mm^2$) | 59 | 114 | 142 | 162 | 176 |
| Area ($2 \times S_2$) between a boss and base plates | 59 | 113 | 144 | 161 | 174 |

-continued

| Item | Sample No. No. 1 | No. 2 | No. 3 | No. 4 | No. 5 |
|---|---|---|---|---|---|
| Output power; Wattage (output voltage; 5 V output frequency; 50 kHz) | 41 | 95 | 133 | 267 | 385 |

From the foregoing, it will now be apparent that a new and improved ferrite core has been found. It should be understood of course that the embodiment disclosed is merely illustrative and is not intended to limit the scope of the invention. Reference should be made to the appended claims, therefore, rather than the specification as indicating the scope of the invention.

What is claimed is:

1. A ferrite core half for use in a power supply circuit comprising:

(a) a circular center boss;

(b) a pair of outer walls positioned at both the sides of said boss for mounting a coil;

(c) a pair of base plates coupling a portion of said boss with said outer walls, said base plates extending from the periphery of said boss to the side surface of said walls wherein said boss, walls and base plates form an E-shaped structure and wherein the end portion of said boss, end portions of said walls and said base plates are all aligned in a single plane; wherein:

(d) each of the outer walls is substantially rectangular with an external linear wall and an inner wall which is coaxial with said circular boss and the width of said external linear wall is larger than the diameter ($d_3$) of the circular boss;

(e) each of said base plates is substantially in a sector shape having a pair of tapers which are gradually opened towards the outer walls each taper having two portions at different opening angles, and the portions of said boss which are coupled to said base plates are less than the whole of the periphery of said boss such that a space is formed between said base plates along the periphery of said boss;

(f) the area ($S_3$) coupling said base plates with said outer walls is larger than the half of the cross-sectional area ($\frac{1}{4}\pi d_3^2$) of said boss;

(g) the area ($S_2$) coupling said boss with the base plates is substantially the same as half of the cross-sectional area ($\frac{1}{4}\pi d_3^2$) of said boss; and (h) the area ($S_1$) of the cross-section of each of said outer walls is substantially the same as half of the cross-sectional area ($\frac{1}{4}\pi d_{32}$) of said boss.

2. A ferrite core half according to claim 1, wherein the corners of said outer walls are curved.

* * * * *